US005572753A

United States Patent [19]

Ruscitto

[11] Patent Number: 5,572,753

[45] Date of Patent: Nov. 12, 1996

[54] PILLOW CASE HEAD COVER

[76] Inventor: Peter A. Ruscitto, 1822 Wilderness Rd., Lancaster, Pa. 17603

[21] Appl. No.: 618,452

[22] Filed: Mar. 14, 1996

[51] Int. Cl.[6] ..... A47G 9/00

[52] U.S. Cl. ..... 5/490; 5/636; 112/475.08

[58] Field of Search ..... 5/490, 485, 653, 5/636, 639, 640, 645; 112/475.08

[56] References Cited

U.S. PATENT DOCUMENTS

| | | | |
|---|---|---|---|
| 1,380,480 | 6/1921 | Jennings | 5/490 |
| 2,412,769 | 7/1946 | Easterbrooks | 5/485 |
| 2,413,828 | 1/1947 | Hirsh et al. | 5/490 |
| 3,840,918 | 2/1974 | Shave . | |
| 4,420,847 | 9/1983 | Smith | 5/490 |
| 4,843,662 | 7/1989 | Handelman | 5/420 |
| 5,127,117 | 7/1992 | Bridges | 5/490 |
| 5,240,330 | 3/1993 | Thompson | 5/639 |

*Primary Examiner*—Alexander Grosz

[57] ABSTRACT

A pillow case head cover made from a single piece of material (30) folded and joined in a method so as to create two primary envelopes. Each primary envelope (44) and (44') containing an opposing secondary envelope (46) and (46'). The primary envelope (48) containing the pillow becomes the pillow case while the other primary envelope becomes the head cover flap (48'). The two primary envelopes with their secondary envelopes therein are the mirror image of each other and therefore interchangeable. The head cover flap (48') may have inserted within a material for additional warmth. Secondary envelopes (46) and (46') assist in holding the respective primary envelope contents in place. Ramifications of the pillow case head cover diversify envelope contents to include, blankets, cushions, towels, rain gear, etc., with embodiments to include size variations and inclusion of conveyance means.

12 Claims, 4 Drawing Sheets

PILLOW CASE HEAD COVER

BACKGROUND-FIELD OF INVENTION

This invention relates to pillow cases, specifically to one which in addition to its usual function as a pillow cover serves as a head cover.

BACKGROUND-DESCRIPTION OF PRIOR ART

Traditionally, pillow cases have been made using two generally rectangular panels of fabric material enclosed along both long sides and one narrow side, either by folding or joining or combination thereof, with the remaining side open so as to receive a generally rectangular pillow. Although this type of pillow case has been in use for a considerable length of time, it provides neither head protection from cool temperatures and drafts nor eye shielding from unwanted light. Medical treatments for various diseases frequently cause hair fall-out resulting in full or partial baldness and loss of body heat through the unprotected scalp. Similarly, those with normal hair loss or baldness suffer from the same discomfort. Persons with migraine headaches often seek light shielding and warmth in an effort to ease pain. Traditional bed sheets and blankets can cover the body from the feet up to the shoulders, and to a lesser extent the neck, but are not intended to cover the head, which by so doing can cause a suffocating condition. Conventional pillow cases designed to receive a pillow through an open end have a tendency for the pillow to slide out from within or for the pillow case itself to creep in a manner so as to expose the pillow.

An early attempt at solving the head covering problem was the use of caps. Frequently these caps would become dislodged while sleeping and the person awakened due to the cooling of the head. One attempt to solve the problem inherent in wearing bed caps is, U.S. Pat. No. 2,412,769 to Easterbrooks (1946), which includes a sheet attached to the pillow case that drapes over the head and secures to each side of the case with button fasteners. The head covering sheet, therefore, is buttoned in place and if sleeping conditions change, the user must awaken and make a deliberate effort to unbutton and reposition or remove the covering sheet. Also, since the head covering material is permanently secured to the case and since this material cannot be changed, the whole assembly may be inapt for certain conditions, such as seasonal extremes in ambient temperature and/or changes in personal requirements, or when used by different individuals.

Another head warming pillow case, U.S. Pat. No. 4,420,847 to Smith (1983), utilizes a cover sewn into the case on three sides forming an envelope for the head to be placed within. This forms a permanent head cover that cannot be removed or significantly repositioned for changing conditions. Although this pillow cover is described as having a head warming flap with warmer material than the pillow case, this too is permanent and may be inapt if conditions require either lighter or heavier materials. Also, dissimilar materials when joined together can cause irregularities, such as stretching or shrinking through ordinary usage and cleaning.

OBJECTS AND ADVANTAGES

Accordingly, several objects and advantages of my invention are:

(a) to provide a pillow case which will have attached to it an arrangement so that the head or parts thereof may be covered;

(b) to provide a pillow case head cover made from a single piece of generally rectangular fabric cut from standard width material using mill selvage as finished edges along both opposing narrow ends thereby reducing costs of labor and scrap;

(c) to provide a pillow case head cover of any width, including those conventionally known as standard, queen, and king, limited only by the length of raw material used where the finished width of the pillow case head cover is determined by the unit width resulting from sequential transverse cuts from selvage to selvage, each cut common to adjacent material sheets with no scrap in-between, and performed with minimum labor;

(d) to provide a pillow case head cover having a construction method of folding and joining inside out which in mass production simplifies joining, minimizes labor, and when positioned right side out conceals the method of joining;

(e) to provide a pillow case which holds the pillow in place and restricts the case itself from creeping in a manner so as to expose the pillow;

(f) to provide a pillow case head cover, with the head cover feature having the tendency to remain in place yet able to be partially or fully repositioned as desired;

(g) to provide a pillow case head cover, with the head cover feature capable of having inserted within it material of different thickness, weight, or warmth to maintain comfort for different ambient temperatures, or capable of having inserted within it a material or substance heated electrically or by other means, or an insertable material with inherent characteristics capable of capturing and retaining body heat thereby offering additional warmth to the user.

Further objects and advantages of my invention will become apparent from a consideration of the drawings and ensuing description.

Figure 1:
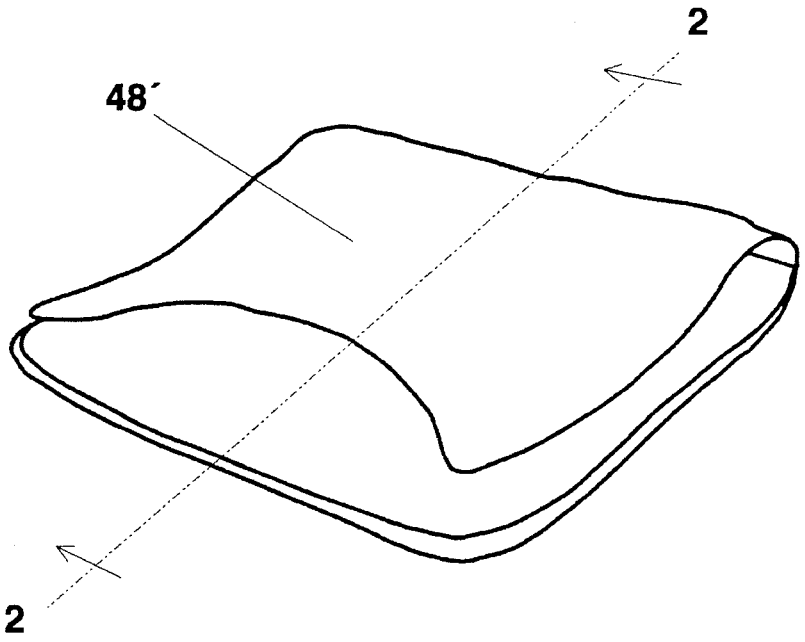
FIG. 1 is a perspective view of my pillow case head cover with a pillow inserted in what is shown as the bottom primary envelope, and the head cover primary envelope shown in a raised or elevated position as would be when in use.

| List of Reference Numerals | |
|---|---|
| 10 - Outer Panel | 18' - Fold Line between Panels 12' & 14' |
| 12 - Middle Panel | 22' - Selvage Edge |
| 14 - Inner Panel | 32 - Joined Edge along Cut Edge 24 |
| 16 - Fold Line between Panels 10 & 12 | 34 - Joined Edge along Cut Edge 26 |
| 18 - Fold Line between Panels 12 & 14 | 28' - Reference Line along Fold Line 16' |
| 20 - Bisecting Line between halves | 38 - Folded Edge along Fold Line 18' |
| 22 - Selvage Edge | 40 - Folded Edge along Fold Line 16 |
| 24 - Cut Edge | 42 - Folded Edge along Fold Line 16' |
| 26 - Cut Edge | 44 - Primary Envelope |
| 28 - Reference Line along Fold Line 16 | 44' - Primary Envelope |
| 36 - Folded Edge along Fold Line 18 | 46 - Secondary Envelope |
| 30 - Material Sheet | 46' - Secondary Envelope |
| 10' - Outer Panel | 48 - Flap |
| 12' - Middle Panel | 48' - Flap |
| 14' - Inner Panel | 50 - Handle |
| 16' - Fold line between Panels 10' & 12' | 52 - Case |

DESCRIPTION OF INVENTION (FIGS. 1 TO 6)

Figure 2:
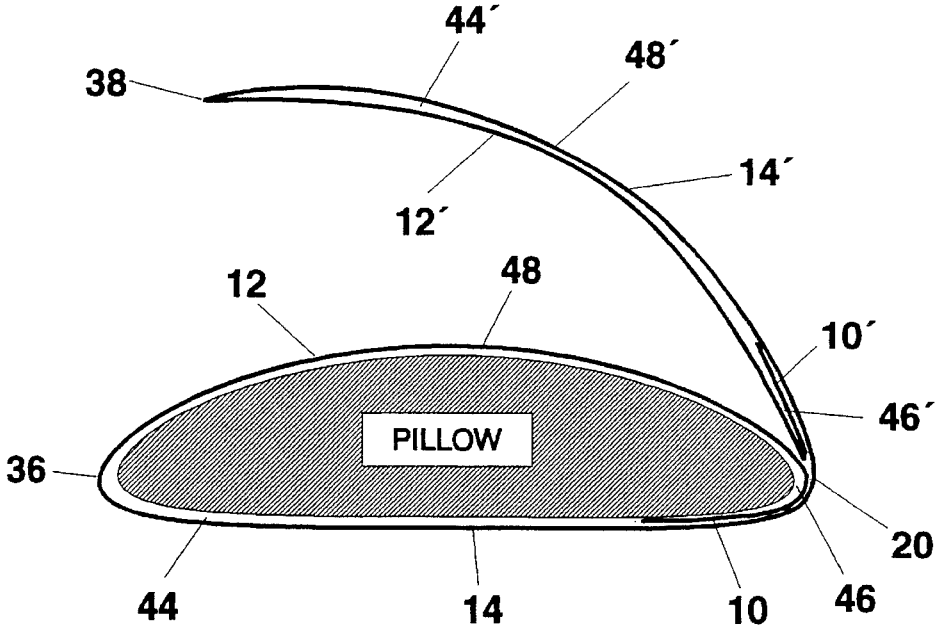
FIG. 2 is a view in detail of the portion indicated by the section lines 2—2 in FIG. 1.
Figure 3:
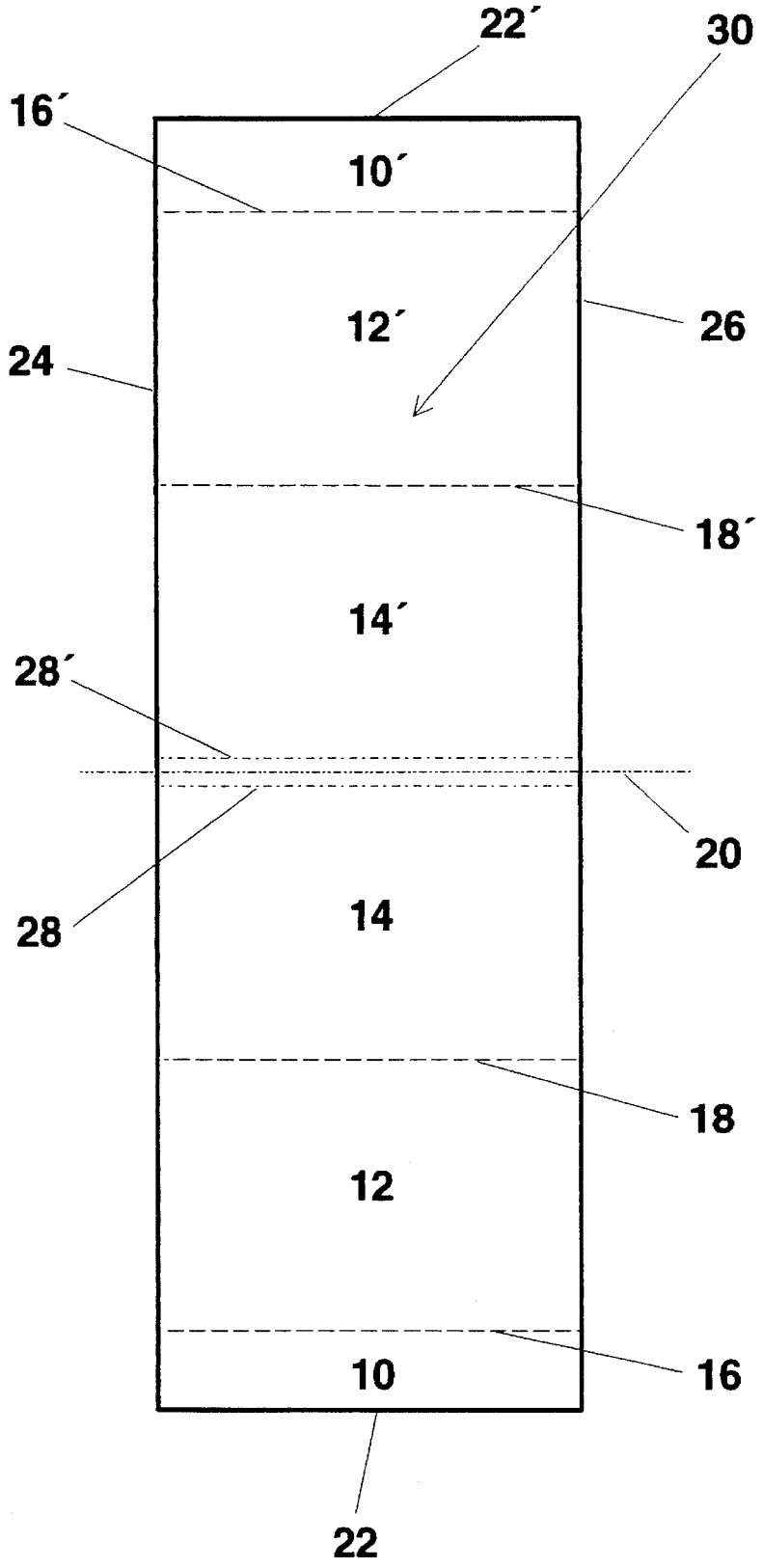
FIG. 3 is a pattern view of my pillow case head cover, prior to folding and assembly, showing panels, edges, bisecting line, reference and fold lines.
Figure 4:
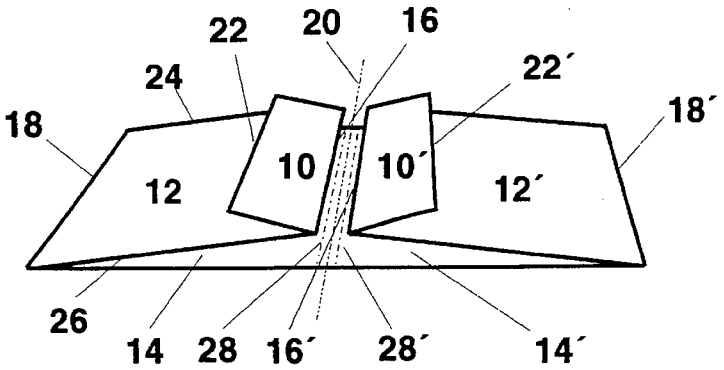
FIG. 4 is a perspective view of my pillow case head cover depicting partial folding prior to joining in an inside out configuration.
Figure 5:
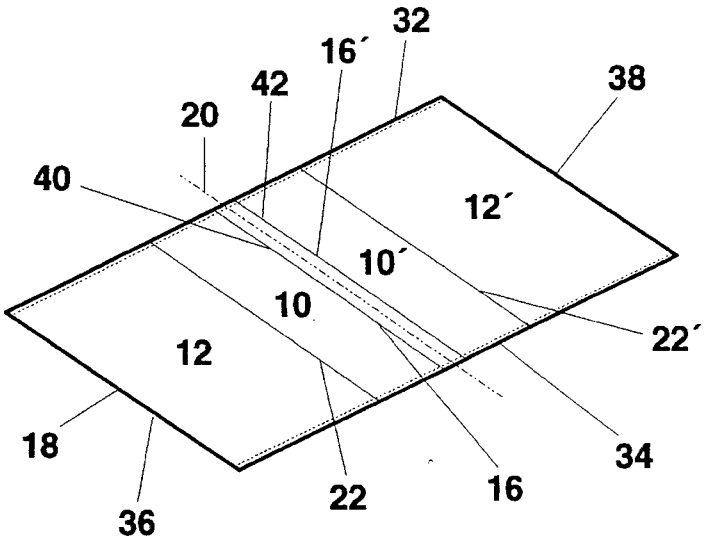
FIG. 5 is a perspective view of my pillow case head cover subsequent to folding, positioning and joining, and while still in an inside out configuration.

A typical embodiment of my pillow case head cover is illustrated in FIGS. 1 and 2. FIG. 3 is a plan or pattern view showing panels, outside edges, bisecting line, and fold and reference lines used in the layout and construction of my pillow case head cover. While other embodiments are possible, it is advantageous to use a single piece of fabric material, which my method allows. Cutting is minimized, fabric material requirements are reduced to a single size eliminating stocking various material sizes. Labor and equipment is unnecessary to join multiple pieces together. FIGS. 4 and 5 show the folding and positioning of material during construction which can be construed as in an inside out configuration. In FIGS. 1 through 6, reference numerals are shown both with and without the prime (') symbol. The reference number shown with the prime symbol corresponds to the like reference number without the prime symbol on the mirror image side of bisecting line 20.

In FIG. 3, material sheet 30 is substantially proportioned in the form of a rectangle according to the desired dimensions of edges 22, 24, 22' and 26, with edge 24 approximately equal to 26 and 22 approximately equal to 22'. Bisecting line 20 divides material sheet 30 into equal halves, one being the mirror image of the other. Bisecting line 20 is common to panels 14 and 14'. Fold line 18 is common to panels 12 and 14 and fold line 18' is common to panels 12' and 14'. Fold line 16 is common to panels 10 and 12 and fold line 16' is common to panels 10' and 12'. Cut edges 24 and 26 are common to panels 10, 12 and 14 and to corresponding panels 10', 12' and 14'. Opposing selvage edges 22 and 22' are edges of panels 10 and 10' respectively and complete the perimeter of material sheet 30. When fabricating material sheet 30, cutting edge 24 simultaneously cuts edge 26 of the adjacent material sheet, the converse correspondingly true. Reference lines 28 and 28', also shown in FIG. 3, are discussed below.

In FIG. 4, panel 12 is folded along fold line 18 and positioned on top of panel 14. Panel 10 is then reverse folded along fold line 16 and positioned on top of panel 12 with fold line 16 substantially in alignment with reference line 28. In this configuration, as shown in FIGS. 4 and 5, fold line 18 becomes edge 36 common with panels 12 and 14 and fold line 16 becomes edge 40 common with panels 10 and 12. Similarly, panel 12' is folded along fold line 18' and positioned on top of panel 14'. Panel 10' is then reverse folded along fold line 16' and positioned on top of panel 12' with fold line 16' substantially in alignment with reference line 28'. Fold line 18' becomes edge 38 common with panels 12' and 14'. Fold line 16' becomes edge 42 common with panels 10' and 12'. After folding and positioning as described above, conventional methods are incorporated to hold the material in place prior to serging, sewing, stitching or other means of joining.

When material sheet 30 is folded and joined, four envelopes are formed, shown in FIG. 2. They are referred to as primary envelopes 44 and 44' and secondary envelopes 46 and 46'. Viewing FIGS. 2 and 4 through 6, primary envelope 44 is formed when panel 12 is folded upon panel 14 and when joined along edges 32 and 34 which become sides one and two. Edge 36 is formed by folding along fold line 18 and becomes the third side of primary envelope 44. Edge 40 is formed by folding along fold line 16 and becomes the fourth side which remains unjoined and open. Similarly primary envelope 44' is formed when panel 12' is folded upon panel 14' and when joined along edges 32 and 34, which become sides one and two. Edge 38 is formed by folding along fold line 18' and becomes the third side of primary envelope 44'. Edge 42 is formed by folding along fold line 16' and becomes the fourth side which remains unjoined and open. Secondary envelope 46 is formed when panel 10 is folded upon panel 12 and when joined along edges 32 and 34. Edge 22 remains unjoined and is the open side of secondary envelope 46. Similarly secondary envelope 46' is formed when panel 10' is folded upon panel 12' and when joined along edges 32 and 34. Edge 22' remains unjoined and is the open side of secondary envelope 46'. Flap 48 contains primary envelope 44 and secondary envelope 46. Flap 48' contains primary envelope 44' and secondary envelope 46'.

FIG. 5 is a perspective view of my pillow case head cover in an inside out configuration, subsequent to folding and positioning. While in this configuration, edges 32 and 34 are joined along their respective full lengths between edges 36 and 38 simultaneously completing the formation of primary pockets 44 and 44' and secondary pockets 46 and 46'. The means of joining becomes hidden when reconfigured right side out.

OPERATION OF INVENTION (FIGS. 1, 2, AND 6)

Figure 6:
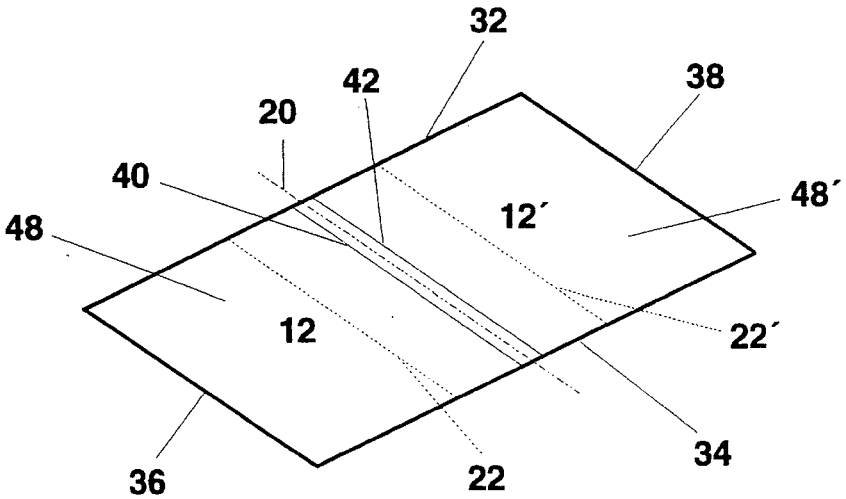
FIG. 6 shows my completed pillow case head cover reconfigured right side out and ready for use.

FIG. 6 shows my completed pillow case head cover following joining, reconfigured right side out and ready for use. A conventional bed pillow can be placed within either of the primary envelopes since one is the mirror image of the other. Once the pillow is inserted in a primary envelope and capped by the proximate secondary envelope, it is held in place and the encapsulating unit becomes the pillow case.

In FIG. 2, which is a view in detail of the portion indicated by the section lines 2—2 in FIG. 1, a pillow is shown inserted in primary envelope 44 and held in place by secondary envelope 46. The remaining primary envelope 44' positioned as shown in FIG. 2 becomes a head cover and in addition aids in pillow retention. With one's head on the pillow, the head cover drapes down over the top of the head towards the neck and shoulder area. While transverse shifting of the head cover along bisecting line 20 is restricted due to its position relative to the primary envelope containing the pillow, the remainder of the head cover can be freely moved about to cover the scalp, face, neck, ears, and eyes, as desired, and nose and mouth to allow adequate breathing as required. For additional warmth, the head cover flap may have placed within it optional material of different thickness, weight, or warmth to maintain comfort for different ambient temperatures. Also the head cover flap is capable of having inserted within it a material or substance heated electrically or by other means, or an insertable material with inherent characteristics capable of capturing and retaining body heat thereby offering additional warmth to the user. Should the user not require a head cover, it can be moved out of the way. Any insert in primary envelope 48' is capped and held in place by secondary envelope 46'.

CONCLUSION, RAMIFICATIONS, AND SCOPE OF INVENTION

Accordingly, the reader will see that my pillow case head cover features a unique way of containing a pillow and providing a head cover, with additional advantages in that

- it permits the production of a pillow case head cover from a single piece of fabric material using a method of folding and assembly which in mass production simplifies joining and minimizes scrap;
- it permits the production of a pillow case head cover using a method of one piece construction thereby eliminating the use of dissimilar materials which when joined together can cause irregularities such as unequal shrinking or stretching through usage and cleaning;
- it provides a pillow case with pockets that hold the pillow in place and restrict the case itself from creeping in a manner so as to expose the pillow;
- it provides a pillow case head cover wherein the head cover tends to remain in place yet may be easily repositioned as desired; and
- it provides a pillow case head cover wherein the head cover can have inserted within it material of differing thickness, weight, or warmth, or material that may be heated electrically or through some other means, for the purpose of maintaining comfort during varying ambient temperatures or for therapeutic purposes.

While my above description contains many specifities, these should not be construed as limitations on the scope of the invention, but rather as an exemplification of one preferred embodiment thereof. Many other variations are possible. For example, in warm climates where draft protection or light shielding is desired rather than warmth, another embodiment of my pillow case head cover would eliminate panels 10 or 10' and adjacent panels 12 or 12' respectively, thereby using a single thickness 14 or 14' respectively, with the head cover becoming a single thickness flap rather than a multiple thickness insertable flap.

Figure 7:
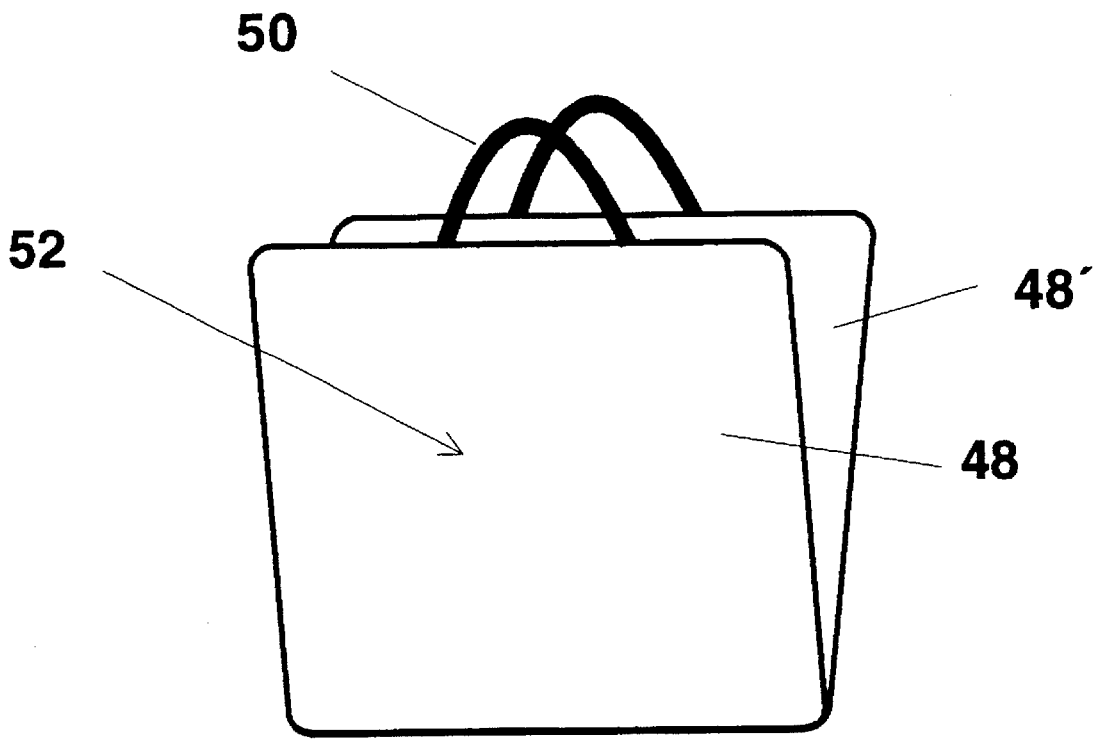
FIG. 7 is an embodiment wherein my pillow case head cover is used as a travel or stadium case.

One ramification would be as a bedding travel case FIG. 7 wherein one primary envelope would contain a pillow and the other primary envelope a folded blanket rather than an insertable material for head warming. In this ramification, the material used for construction could be a heavier or more durable casing material and of a design more suitable for such use. Straps, hook and loop fasteners or other means may be incorporated to hold the two halves together, however carrying handles such as handle 50 paired may render such fasteners unnecessary. Another ramification as shown in FIG. 7 would be as a stadium cushion and blanket carrying case 52, appropriately sized, wherein one primary envelope would contain a cushion, rather than a pillow, and the other primary envelope a folded blanket rather than an insertable material for head warming. The material used for construction could be of a heavier or more durable casing, water resistant or water proof, and upon which may be displayed, words, patterns, logos, or other designs suitable for stadium events or team preferences. Still another ramification would be as a beach bag, also FIG. 7, wherein one side would hold towels, rather than a pillow, the other side a beach blanket, rather than an insertable material for head warming, and the outer sides appropriately decorated.

Thus the scope of the invention should be determined by the appended claims and their legal equivalents, rather than by the examples given.

I claim:

1. A pillow case head cover made from a single piece of substantially rectangular shaped fabric material, the long dimension of said fabric material divided along a bisecting line into substantially equal halves thereby creating near mirror image segments each comprised of an outer, middle, and inner panel, wherein the outer panels, dimensioned somewhat less in length than the adjacent middle panels, are folded upon the adjacent middle panels, said middle panels dimensioned somewhat less in length than the adjacent inner panels, the combination of said outer and said middle panels folded upon said adjacent inner panels, all panels thus folded being joined along both long dimension edges substantially perpendicular to said bisecting line, thereby creating two opposing primary envelopes closed on three sides by folding and joining, each with openings adjacent to and substantially parallel to said bisecting line and each of the primary envelopes having contained within secondary envelopes closed on three sides by folding and joining with the opening opposite in direction to that of the primary envelopes.

2. The pillow case head cover in claim 1 wherein the primary envelopes are interchangeable, either of which able to receive a pillow through the open end, the primary envelope not containing the pillow becoming a head cover flap.

3. The pillow case head cover in claim 2 wherein said head cover flap is common with the primary envelope containing the pillow along said bisecting line and as such is one therewith, the remaining three edges of said head cover flap unattached and free.

4. The pillow case head cover in claim 2 wherein said head cover flap is capable of having a supplemental material inserted therein.

5. The pillow case head cover in claim 1 wherein the contents of the primary envelopes are held in place by the secondary envelopes within.

6. The pillow case head cover in claim 1 wherein the two opposing primary envelopes, folded upon themselves, resist the outward movement and exposure of any content of the primary envelopes.

7. The method of making a pillow case head cover from a single piece material sheet of substantially rectangular shaped fabric material, the long dimension of said fabric material divided along a bisecting line into substantially equal halves thereby creating near mirror image segments each comprised of an outer, middle, and inner panel, wherein the outer panels, dimensioned somewhat less in length than the adjacent middle panels, are folded upon the adjacent middle panels, said middle panels dimensioned somewhat less in length than the adjacent inner panels, the combination of said outer and said middle panels folded upon said adjacent inner panels, all panels thus folded being joined along both long dimension edges substantially perpendicular to said bisecting line, thereby creating two opposing primary envelopes closed on three sides by folding and joining, each with openings adjacent to and substantially parallel to said bisecting line and each of the primary envelopes having contained within secondary envelopes closed on three sides by folding and joining with the opening opposite in direction to that of the primary envelopes.

8. The method in claim 7 wherein said material sheet is cut transversely from standard width fabric material, the transverse cut edges becoming the long dimension edges and the selvage edges becoming the narrow dimension edges of said material sheet.

9. The method in claim 8 wherein a transverse cut of a material sheet becomes a transverse cut of an adjacent material sheet.

10. The method in claim 8 wherein the width resulting from sequential transverse cuts determines the pillow case head cover width.

11. The method in claim 8 wherein the selvage edges are contained within the primary envelopes when folded and joined, therefore concealed from view in normal use.

12. The method in claim 7 wherein the material sheet is folded and joined in an inside out configuration.

* * * * *